US005152017A

United States Patent [19]

Jaeger

[11] Patent Number: 5,152,017

[45] Date of Patent: Oct. 6, 1992

[54] MUMMY-SHAPED SLEEPING BAG HAVING A FASTENER EXTENDING CURVILINEARLY BETWEEN FOOT AND HEAD ENDS OF THE BAG

[75] Inventor: Knut Jaeger, Kirchheim/Teck, Fed. Rep. of Germany

[73] Assignee: Knut Jaeger Marketing & Production BIG PACK GmbH, Bissingen-Teck, Fed. Rep. of Germany

[21] Appl. No.: 756,317

[22] Filed: Sep. 6, 1991

[30] Foreign Application Priority Data

Sep. 7, 1990 [DE] Fed. Rep. of Germany ... 9012807[U]

[51] Int. Cl.[5] ..... A47C 29/00

[52] U.S. Cl. ..... 5/413; 2/69.5

[58] Field of Search ..... 5/413, 417, 485; 2/69.5, 69, 64, 80, 227, 94

[56] References Cited

U.S. PATENT DOCUMENTS

| | | | |
|---|---|---|---|
| 2,324,665 | 7/1943 | Ayres | 2/69.5 |
| 2,338,226 | 6/1944 | Bauer | 5/413 |
| 2,537,537 | 6/1951 | Ljungberg | 2/69.5 |
| 2,730,721 | 1/1956 | Van Veen | 2/69.5 |
| 4,238,871 | 12/1980 | Cannon | 2/69.5 |
| 4,485,489 | 12/1984 | Pilié | 2/69 |
| 4,884,303 | 12/1989 | Scherer | 2/69.5 |
| 4,998,296 | 3/1991 | Stames | 2/69.5 |

FOREIGN PATENT DOCUMENTS

| | | | |
|---|---|---|---|
| 2936414 | 5/1981 | Fed. Rep. of Germany | 2/69.5 |

*Primary Examiner*—Renee S. Luebke
*Assistant Examiner*—F. Saether
*Attorney, Agent, or Firm*—Scully, Scott, Murphy & Presser

[57] ABSTRACT

A sleeping bag having a zip fastener of the zipper or slide fastener type extending from the foot end up to the head end thereof. More specifically, the sleeping bags may be of practically any kind of design; however, especially down-filled sleeping bags which are of conventional rectangular shape as well as of the so-called mummy configuration. The zip fastener extends continually from the foot end to the head end of the sleeping bag runs between the foot end and the head end of the sleeping bag in a generally S-shaped or curvilinear path. Preferably, the zip fastener extends along the side of the bag in the region of the foot end, and in the region of the head end is formed as a central zip fastener located on the chest side of a user.

4 Claims, 2 Drawing Sheets

MUMMY-SHAPED SLEEPING BAG HAVING A FASTENER EXTENDING CURVILINEARLY BETWEEN FOOT AND HEAD ENDS OF THE BAG

BACKGROUND OF THE INVENTION

1. Field of the Invention

The present invention relates to a sleeping bag having a zip fastener of the zipper or slide fastener type extending from the foot end up to the head end thereof. More specifically, the invention pertains to sleeping bags of practically any kind of design; however, especially to down-filled sleeping bags which are of the conventional rectangular shape as well as of the so-called mummy configuration.

A zip or slide fastener, frequently referred to as a zipper which renders it easier for a person to slip into the sleeping bag, is critically with regard to its ease of manipulation by the user and its disadvantage as an undesirable cold-transmitting bridge. Heretofore, sleeping bags have been constructed with either a central slide or zip fastener or alternatively, with a zip fastener opening along the side of the bag, with the zip fastener extending either continuously from the foot end to the head end, or also being formed as a shorter zip fastener extending only over an upper portion of the length of the sleeping bag.

2. Discussion of the Prior Art

Sleeping bags which are equipped with a short central zip fastener can be more easily manufactured and insulated. The operation of a zip fastener which is located in a region on the chest is easier to handle than one situated at the side near the region of the shoulder. A disadvantage encountered with short central zip fasteners or even short side zip fasteners resides in that it is not possible to vent or air out the sleeping bag in the region of the foot end through a partial opening thereof. It is also not possible to employ such a sleeping bag as a cover or blanket since it cannot be opened completely.

Although slide or zip fasteners which extend continuously from the foot end to the head end of the sleeping bag form a larger cold-transmitting bridge this can, however, be controlled to a great extent through the provision of an appropriate covering or flap; while nevertheless rendering considerably easier the entry of the user, facilitating the airing out of the foot end; and in combination with a zip fastener which extends about in the region of the foot end, to convert the bag into a cover or blanket. Sleeping bags of this kind can also be joined together by the through-extending zip fastener in order to produce a double sleeping bag.

Inasmuch as sleeping bags with full-length or continuous side zip fasteners can be employed in a greater variety of ways they have been more successfully commercialized in the market. However, a zip fastener which is situated at the side in the shoulder region at the head end of the bag is more difficult to manipulate by the user and creates the problem of providing insulation in precisely the important shoulder region of the sleeping bag.

SUMMARY OF THE INVENTION

Accordingly, it is an object of the invention to improve upon and optimize the arrangement of the slide or zip fastener on the sleeping bag so as to ameliorate the above-mentioned disadvantages.

In order to attain the above-mentioned object, the invention contemplates that the zip fastener which extends continually from the foot end to the head end of the sleeping bag runs between the foot end and the head end of the sleeping bag in a generally S-shaped or curvilinear path.

It is also advantageous when the zip fastener extends along the side of the bag in the region of the foot end, and in the region of the head end is formed as a central zip fastener located on the chest side of a user.

At a location in the chest region of the sleeping bag, the zip fastener is expediently situated for manipulation by a user. The presence of a possible cold-transmitting bridge is avoided in the shoulder region of the person lying within the sleeping bag. At the foot end of the sleeping bag there can be carried out an airing at the side with a suitable known construction of the zip fastener which is able to be opened and closed in two directions. Also the use of the sleeping bag as a cover is principally not impaired by the S-shaped or curvilinear configuration of the zip fastener.

BRIEF DESCRIPTION OF THE DRAWINGS

Reference may now be had to an exemplary embodiment of the invention in connection with a down-filled sleeping bag having a mummy shape, taken in conjunction with accompanying drawings; in which.

DETAILED DESCRIPTION

Figure 1:
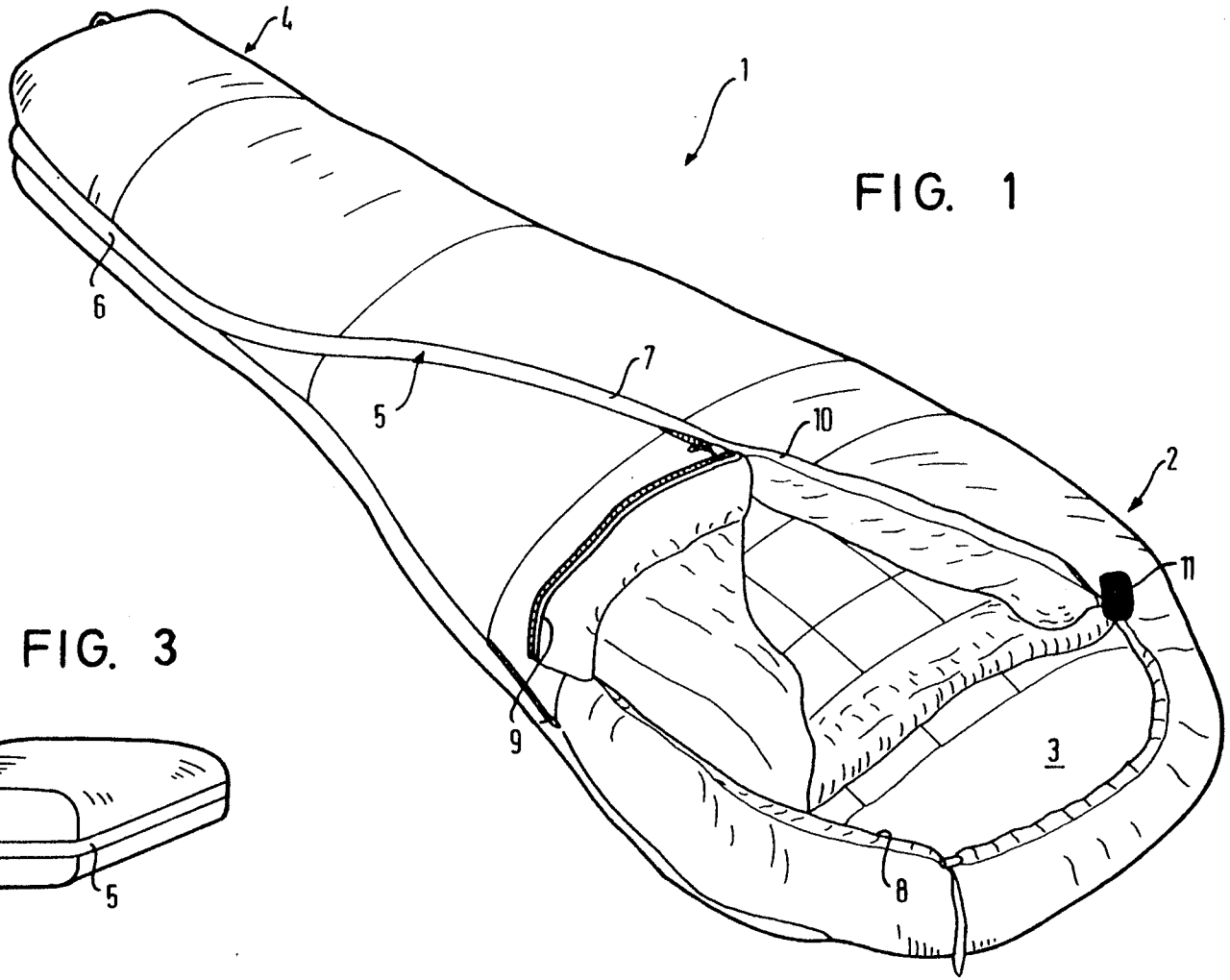
FIG. 1 illustrates a perspective view of the sleeping bag with the zip fastener being partly open in the region of the head end.
Figure 3:
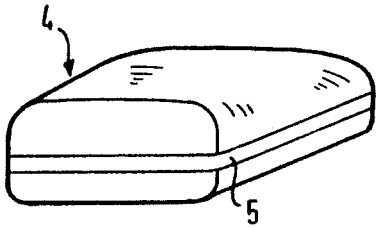
FIG. 3 illustrates a fragmentary view of the foot end of the sleeping bag.
Figure 2:
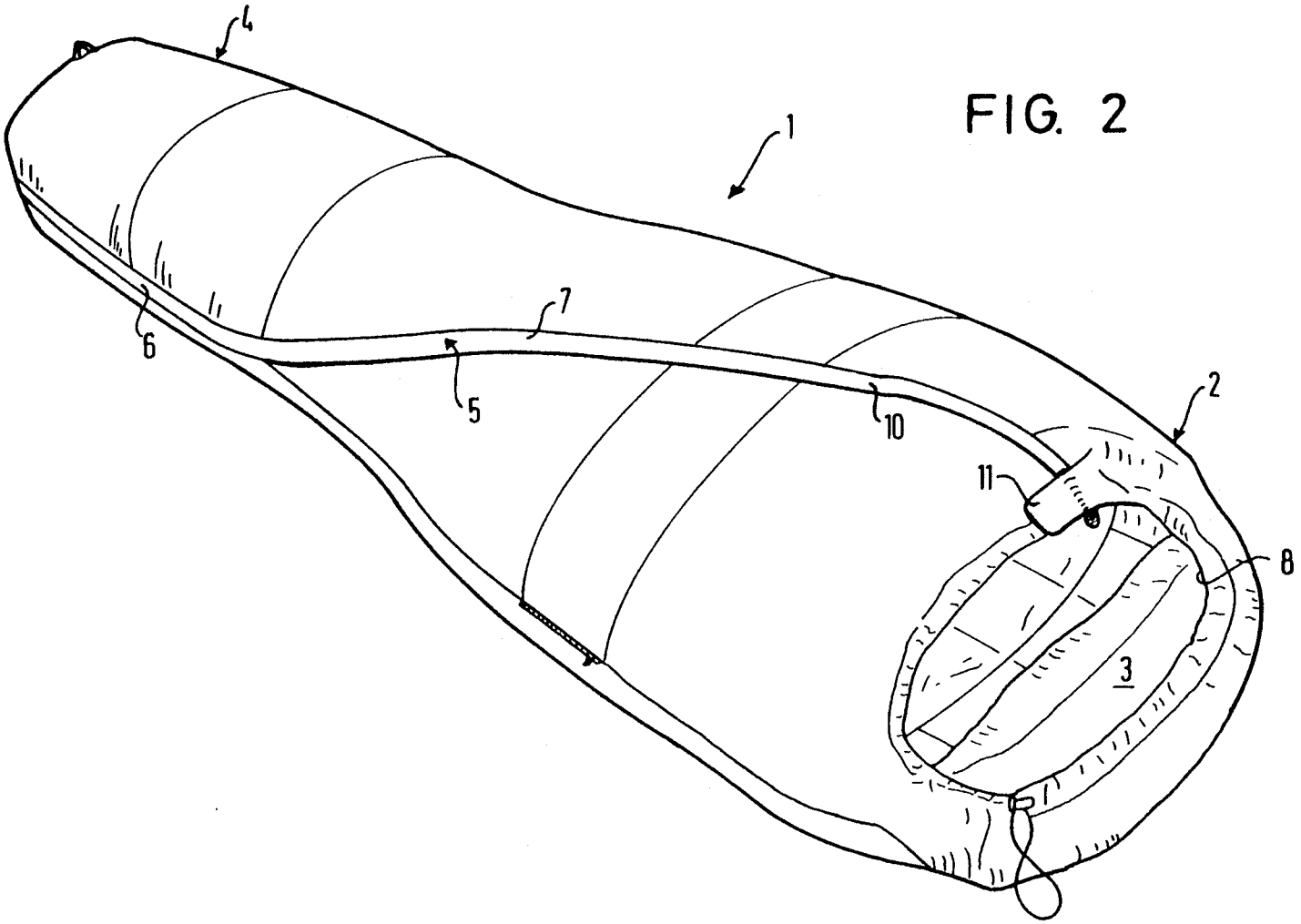
FIG. 2 illustrates a view similar to FIG. 1 with the zip fastener being shown as completely closed.

A sleeping bag, indicated in general by reference numeral 1, has a conventional head end portion 2 with a head pillow region 3 and a foot end 4. The full-length or continuous zip fastener 5 closing the entry opening of the sleeping bag extends along the side of the bag in the region of the foot end 4 in the area indicated by 6, and from there; in effect, after about the lower third of the length of the sleeping bag, follows an S-shaped or curvilinear path, in the region herein indicated by 7, up to the opening 8 for a user's head in the head end 2. The entire zip fastener is covered with conventional covering strips or flaps 9 and 10, and the slider for the zip fastener can be secured at the end of the zip fastener in the head opening 8 by a tongue 11 possessing a hook-and-loop (Velcro-type) fastener. As can be seen in FIG. 3, the zip fastener 5 extends transversely about the end surface of the foot end.

In the illustrated embodiment, the zip fastener 5 extends over approximately the upper two thirds of the length of the sleeping bag, in essence, the length identified by 7, along a shallow curve, which curves into the end opening 8. The position of the zip fastener in the head opening 8 is offset sideways from the center towards the shoulder region of a user of the sleeping bag; in effect, towards the side which is distant from the location of the zip fastener at 6 along the side of the foot end. As a result, there is provided an entry opening which is particularly expediently situated for the user of the sleeping bag, and the path of the zip fastener conforms even better to the closing motion which can be easily carried out by the arm of the user.

What is claimed is:

1. In a sleeping bag of mummy shape including a foot end portion and a head end portion having a pillow region and a head opening, said sleeping bag having a zip fastener extending at the side from the foot end portion to the head end portion, said zip fastener traversing a path extending into the head end opening and extending at least partially in a generally S-shaped curvilinear path; the improvement comprising in that the zip fastener (5) extends along the side of the sleeping bag in the region of the foot end portion (4) for about the lower third of the length of the sleeping bag (1) and then extends over about the upper two-thirds of the length of the sleeping bag along a generally S-shaped curvilinear path (7) into the head end opening (8) offset laterally towards a shoulder side at the head end portion which is opposite the side along which the zip fastener extends in the region of the foot end portion (4).

2. A sleeping bag as claimed in claim 1, wherein said zip fastener (5) extends along the side of the sleeping bag in the region of the foot end portion (4) for about the lower third of the length of the sleeping bag (1) then extends therefrom in said generally S-shaped curvilinear (7) for about the middle third of the length of the sleeping bag, and then extends in a straight line along about the upper third of the length of the sleeping bag into the head end opening (8).

3. A sleeping bag as claimed in claim 1 or 2, wherein the zip fastener (5) extends transversely around the lower end of the foot end portion (4) of said sleeping bag.

4. A sleeping bag as claimed in claim 1, wherein the zip fastener (5) is openable and closeable in two opposite directions along the length of said zip fastener.

* * * * *